US009207013B2

(12) United States Patent
Kaiser et al.

(10) Patent No.: US 9,207,013 B2
(45) Date of Patent: Dec. 8, 2015

(54) METHOD OF USING A MOISTURE METER DURING A LAUNDERING PROCESS

(71) Applicant: Cintas Corporation, Cincinnati, OH (US)

(72) Inventors: Kasey T. Kaiser, Milford, OH (US); Pawan Kumar, Mason, OH (US)

(73) Assignee: Cintas Corporation, Cincinnati, OH (US)

( * ) Notice: Subject to any disclaimer, the term of this patent is extended or adjusted under 35 U.S.C. 154(b) by 299 days.

(21) Appl. No.: 13/709,160

(22) Filed: Dec. 10, 2012

(65) Prior Publication Data

US 2013/0091725 A1 Apr. 18, 2013

Related U.S. Application Data

(62) Division of application No. 12/344,298, filed on Dec. 26, 2008, now abandoned.

(60) Provisional application No. 61/016,961, filed on Dec. 27, 2007.

(51) Int. Cl.
*F26B 7/00* (2006.01)
*D06F 58/28* (2006.01)

(52) U.S. Cl.
CPC . *F26B 7/00* (2013.01); *D06F 58/28* (2013.01); *D06F 2058/2816* (2013.01); *D06F 2058/2883* (2013.01)

(58) Field of Classification Search
CPC ..... D06F 58/28; D06F 2058/2883; D06F 2058/2816; F26B 7/00
USPC ..... 68/12.02, 13 R, 20, 27
See application file for complete search history.

(56) References Cited

U.S. PATENT DOCUMENTS 3,269,027 A 8/1966 Harnden, Jr.
3,400,467 A 9/1968 Drace (Continued)

FOREIGN PATENT DOCUMENTS

GB 968399 A 9/1964

OTHER PUBLICATIONS

International Searching Authority, International Search Report and Written Opinion of the International Searching Authority, PCT/US2008/088358, Mar. 16, 2009, 11 pgs.

(Continued)

*Primary Examiner* — Joseph L Perrin
(74) *Attorney, Agent, or Firm* — Wood, Herron & Evans, LLP

(57) ABSTRACT

A method of processing at least one garment involves a local environment with ambient moisture, a garment having a moisture content, a plurality of work stations, and a threshold amount of moisture. The plurality of work stations operate according to a plurality of parameters. The threshold amount of moisture is the amount of ambient moisture naturally absorbed by the garment. The method includes a processing step, a measuring step, a determining step and an adjusting step. The garment is processed through at least one of the work stations during the processing step. During the measuring step, the moisture content of the garment is measured. The relationship between the measured moisture content and the threshold amount of moisture is determined during the determining step. And, at least one parameter is adjusted based on the relationship between the measured moisture content and the threshold amount of moisture during the adjusting step.

20 Claims, 4 Drawing Sheets

(56) References Cited

U.S. PATENT DOCUMENTS

| | | | | |
|---|---|---|---|---|
| 5,682,684 | A | 11/1997 | Wentzlaff et al. | |
| 7,268,313 | B1 | 9/2007 | Aldridge | |
| 2003/0019798 | A1* | 1/2003 | Capps et al. | 209/630 |
| 2003/0136535 | A1* | 7/2003 | Lilburn | 162/198 |

OTHER PUBLICATIONS

Delmhorst Instrument Co., BD-2100 Owner's Manual, Rev. Jan. 2011, 14 pgs.

Office Action, U.S. Appl. No. 12/344,298, filed May 10, 2012, 23 pgs.

Office Action, U.S. Appl. No. 12/344,298, filed Sep. 21, 2012, 15 pgs.

* cited by examiner

METHOD OF USING A MOISTURE METER DURING A LAUNDERING PROCESS

CROSS REFERENCE TO RELATED APPLICATION

This is a divisional of U.S. patent application Ser. No. 12/344,298 filed on Dec. 26, 2008, which in turn claimed priority to U.S. Provisional Patent Application Ser. No. 61/016,961 filed Dec. 27, 2007 and each of these prior applications is hereby incorporated by reference in its entirety.

BACKGROUND OF THE INVENTION

Industrial and commercial laundering facilities have the capability of processing thousands of garments a day. As a result of this capacity, it may be beneficial to better define process controls to reduce cost and increase efficiency. Garments may naturally absorb ambient moisture present in the local environment. Consequently, it may be a waste of resources and inefficient to dry garments below a threshold moisture content (i.e. the ambient level of moisture). Therefore, it may be beneficial to monitor the moisture content of a garment at one or more points during the laundering process to allow process parameters to be adjusted to reduce cost and increase efficiency.

DETAILED DESCRIPTION OF THE INVENTION

Figure 2:
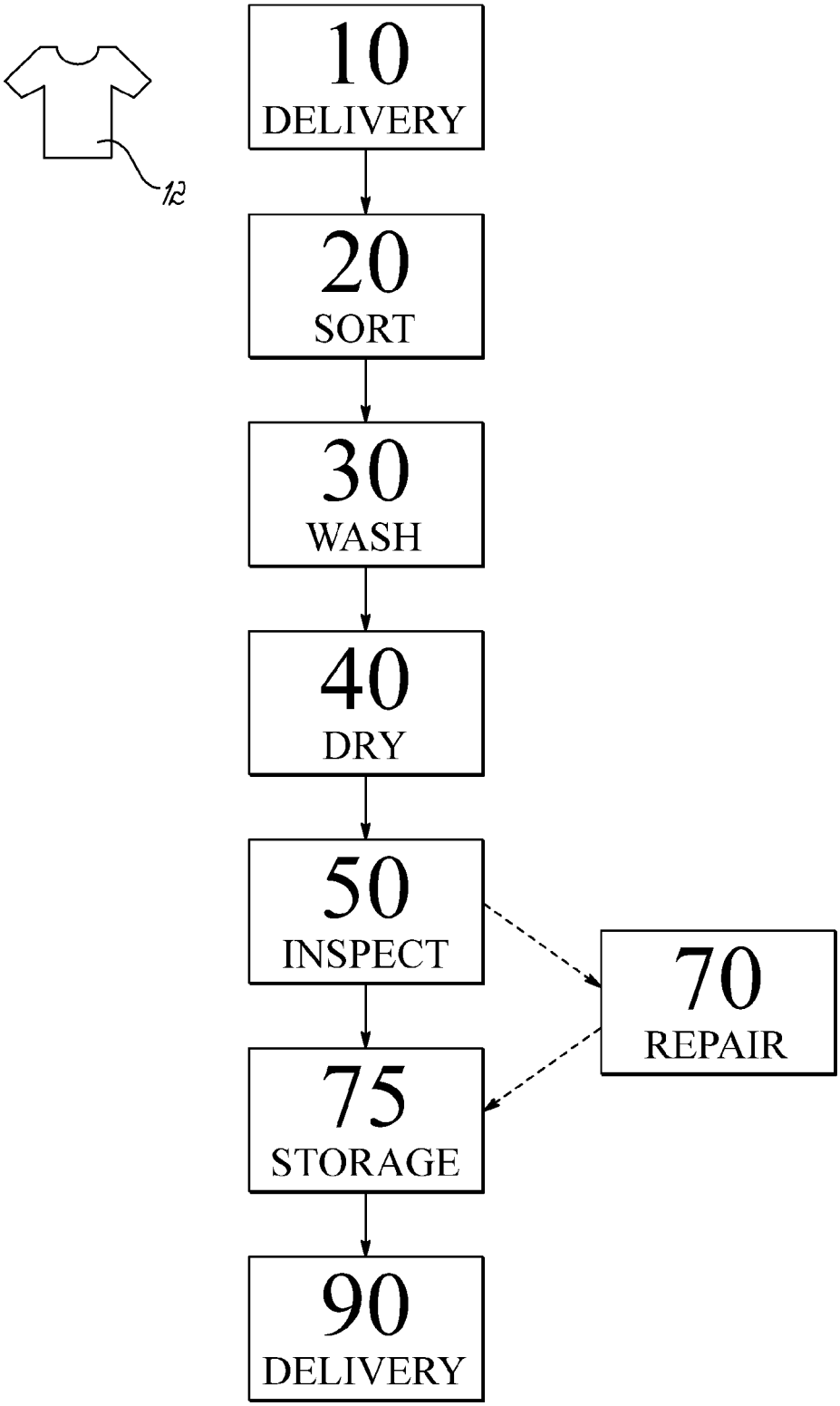
FIG. 2 PRIOR ART
FIG. 2 is a schematic representation of a generally-known example of a process for laundering, drying and sorting garments.

Referring now to the figures, FIG. 2 shows a schematic of a generally-known process for laundering, drying, and sorting garments. While the steps and work stations involved in the processes shown in FIGS. 2 and 3 will be described in a particular order, it will be appreciated that the steps and work stations involved in these processes may be arranged in any suitable order. As will be described herein, the inventive method of the present invention is an adaptation of this prior art method of garment processing. As used herein, "garments" includes clothing as well as any other washable items comprised of fabric including but not limited to towels, linens, mop heads, rugs or any other suitable item.

Garments 12, which may be soiled, may be delivered to the laundering facility by delivery vehicles, which may be delivery trucks. This incoming delivery step is indicated by box 10 in FIG. 2. Each delivery of soiled garments 12 corresponds to a specific route. The soiled garments 12 are unloaded from the vehicle and may undergo a pre-wash sorting 20 where the garments 12 may be separated by the type of garment 12 (e.g. garage wear, lab wear, etc.), by color (e.g. light, dark, etc.) or any other suitable characteristic.

After the pre-wash sort 20, the garments 12 may be transferred to a washing work station 30, which may comprise washing machines, where the garments 12 are washed. For the purposes of this description, "wash", "washing" and "washed" may mean traditional laundering, dry cleaning, and any other suitable method or process and "washing machine" may refer to an apparatus for washing or any other suitable device. After being processed through the washing work station 30, the garments 12 are processed through a drying work station 40, during which the garments 12 may be dried using dryers, by passing through a steam tunnel or any other suitable method or device. Once dried, the garments 12 are transferred to an inspection work station 50. At the inspection work station 50, a worker may inspect the garments for damage such as rips, tears, missing buttons and such.

After inspection, each garment 12 is configured for processing and placed on a conveyor. Garments 12 may be configured for processing by being hung on hangers, folded or by undergoing any other suitable preparation. The garments 12 may be delivered as configured for processing or may be subsequently configured for delivery by being hung on hangers, folded or by undergoing any other suitable preparation. In one embodiment, a garment 12 is configured for processing by being hung from a clothes hanger where the hanger is attached to a carrier that interfaces with the conveyor. If the garment 12 is in satisfactory condition, the garment 12 may be transferred to a sorting and storage work station 75. Alternatively, if the garment 12 has sustained some damage and is in need of repair, the garment 12 may be transferred to a repair work station 70. Once the garment 12 has been repaired, the garment 12 may be transferred to the sorting and storage work station 75. Additionally, the garments 12 may be steamed or pressed any time after washing, or not at all, and do not necessarily have to be steamed or pressed prior to sorting.

At the sorting and storage station 75, the garment 12 may be directed to a pre-sort buffer (not shown) determined by the delivery route for the garment 12. The pre-sort buffer may consist of several rails, where each route is temporarily assigned to one or more rails. Once all, or a substantial majority, of the garments 12 for a route are collected on a rail, the garments 12 may be directly conveyed to a sorter (not shown) where they are sorted by delivery sequence within the route. Once sorted, the garments 12 may be automatically and immediately conveyed to storage where they are stored until they are scheduled for loading and delivery 90.

Alternatively, the sorting and storage station 75 may incorporate a multi-destination storage capability (not shown) in lieu of a pre-sort buffer. In this version, the garments 12 may be grouped together in storage based on route, but may be out of sequence. Each garment 12 may be conveyed to a storage rail corresponding to its route. The garments 12 may remain in storage until it is determined that they should be sorted. From storage, the garments 12 may be conveyed to a sorter where they are sorted by delivery sequence within the route. Once sorted, the garments 12 may be conveyed to a staging area (not shown) prior to being transferred to loading and delivery 90, may be loaded for delivery, or may be conveyed back into storage and loaded for delivery at a later time.

Each garment 12 may include a permanent or temporary unique identifier (not shown), such as an alphanumeric code, which may be unique to each garment or a class of garments. The identifier may be manually readable by workers or may be encoded in a machine readable format, such as a bar code, radio frequency (RF) chip, and any other suitable method or device. The identifier may allow users to track the progress of a particular garment or class of garments through the process or be used to collect various other types of data regarding a particular garment, a specific class of garments, certain steps of the process, the process as a whole or any other suitable category of information.

Figure 1:
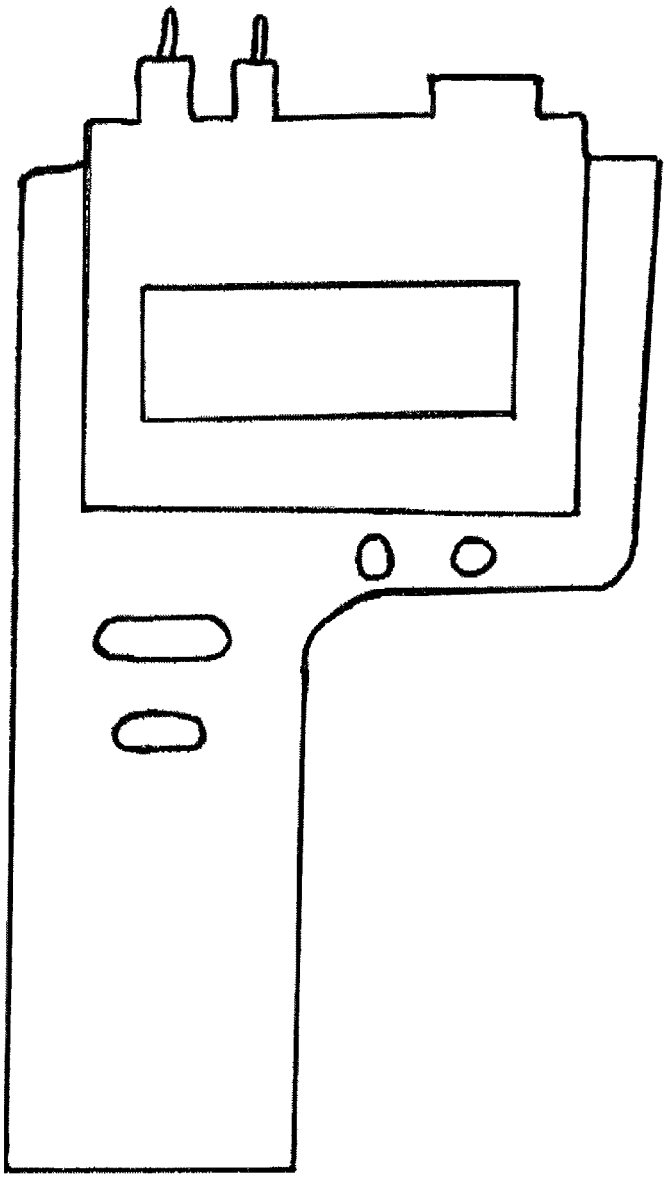
FIG. 1 PRIOR ART
FIG. 1 depicts a prior art moisture meter.

Embodiments of the improved method of garment processing of the present invention include a method of laundering, drying and sorting garments that comprises measurement of the moisture content of at least one garment 12 at one or more stages of the process. The moisture content may be observed and recorded. The moisture content may be measured using a moisture meter or any other suitable device. In one embodiment, the moisture content may be measured using a device similar to the BD-2100 Moisture Meter device manufactured by the Delmhorst Instrument Company (www.delmhorst.com), an example of which is shown in FIG. 1. As one of ordinary skill appreciates, the moisture meter of FIG. 1 is a hand-held and manually operated meter with which a user pushes the meter's contact pins into the item for which the moisture is to be measured, such as the garment 12. With the contact pins driven into the garment 12, the user reads the moisture content of the garment displayed on the meter after the read key on the meter is depressed. According to the testing procedures for the meter, corrections may be required for the temperature and type of material being tested as well as the use of insulated or non-insulated contact pins. Obviously, use of this particular device is not required within the scope of this invention. The moisture meter may be adapted to measure moisture content in various types of garments. The moisture content may then be measured and evaluated. Based on the results, the steps in the laundering, drying, and sorting process may be changed, equipment may be modified, equipment settings may be adjusted, or any other similar modifications may be made. In some embodiments of the inventive method, the garments may include a permanent or temporary unique identifier, as described above. The identifier may facilitate collection of data regarding a particular garment, a specific class of garments, certain steps of the process, the process as a whole or any other suitable category of information.

Figure 3:
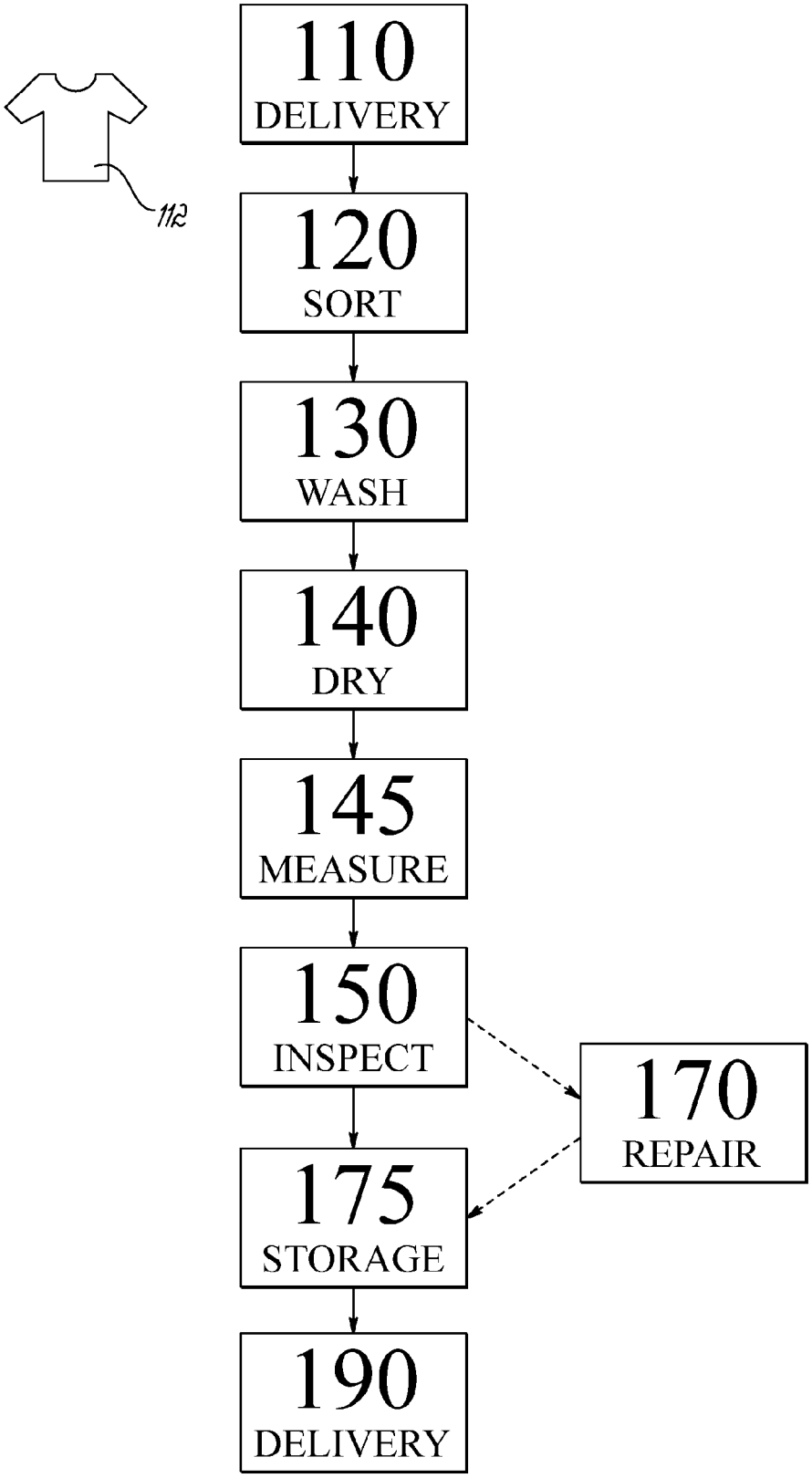
FIG. 3 is a schematic representation of the process shown in FIG. 2 incorporating the step of measuring the moisture content of one or more garments.

In one embodiment of the inventive method, shown in FIG. 3, the laundering, drying and sorting process is similar to the generally-known process described above and shown in FIG. 2; however it includes the additional step of moisture content measurement 145. As shown in FIG. 3, the process includes the following steps and work stations: incoming delivery 110, pre-wash sorting 120, washing work station 130, drying work station 140, moisture content measurement 145, inspection work station 150, repair work station 170, sorting and storage work station 175, and loading and delivery 190. In this embodiment, the moisture content measurement 145 occurs directly after drying 140. However, it will be appreciated that the moisture content measurement 145 may be incorporated at one or more other stages during the process. For example, the moisture content measurement may occur prior to drying, after inspection, or any other suitable stage of the process. Additionally, the method may include multiple moisture content measurement work stations or steps. During the moisture content measurement 145, an operator may use a moisture meter or other similar device to measure the moisture content of one or more garments 112. To obtain accurate information, preferably 30 or more garments 112 are tested per load. However, any suitable number of garments may be tested per load.

Garments may naturally absorb ambient moisture present in the local environment. Consequently, it may be inefficient and a waste of resources to dry garments below a threshold moisture content (i.e. the ambient humidity). For example, if a garment undergoes the drying process and has a moisture content of 1% after drying, once the garment is removed from the dryer and exposed to the environment (such as, for example while awaiting transfer to the next station, while undergoing repair, while being kept in storage, etc.) the garment may begin absorbing ambient moisture. As a result, after drying, the moisture content of the garment may have increased to equal the ambient humidity. Therefore, efficiency may be gained and resources may be saved if the parameters of the process are set such that the garment is only dried sufficiently to reduce the moisture content of the garment to a level that is approximately equal to the humidity.

In the embodiment of the present invention shown in FIG. 3, if the moisture content of the garment 112, or the average of the garments tested, is below a threshold amount, such as, for example 6% or any other suitable amount, then the parameters of the laundering, drying and/or sorting process may be adjusted to achieve a moisture content approximately equal to or above the threshold amount for garments 112 that undergo the process in the future. For instance, the moisture content of a garment 112 may be measured after the drying step 140 and prior to the inspection step 150. Based on that data, the speed of the washing machines may be adjusted for a future load of garments 112 in order to achieve the desired moisture content in the future load.

Alternatively, in addition to, or instead of, adjusting parameters for garments 112 that undergo the process in the future, parameters for steps not yet completed by the garment 112 presently being measured may be adjusted to achieve the desired moisture content in the current load of garments. For instance, if the moisture content is measured after washing 130 and prior to drying 140, the temperature at which the garments 112 are dried in the drying step 140 may be adjusted to achieve a moisture content in the current load of garments 112 substantially equal to the threshold amount. One or more adjustments to the process may be made, including but not limited to adjusting the drying time for the garments 112, changing the temperature at which the garments 112 are dried, adjusting the speed of the washing machines, adjusting the speed of the conveyor transporting the garments 112, or any other suitable modifications to the process.

In one embodiment of the present invention, as a result of monitoring the moisture content of one or more garments after the drying process, the drying time for the garments may be decreased and the temperature at which the garments are dried may be increased. The following two Tables A and B provide sample data and calculations that demonstrate the potential time and financial savings resulting from these adjustments to the process parameters in a sample laundering facility.

TABLE A

| FORMULA | Classification | Loads Ran | Old Time | New Time | Time Saved Per Load | Total Time Saved |
|---|---|---|---|---|---|---|
| 1 | Color Shirts | 61 | 2 | 1 | 1 | 61 |
| 2 | Color Pants | 70 | 8 | 5 | 3 | 210 |
| 3 | Food Service White | 17 | 13 | 10 | 3 | 51 |
| 4 | Blood Whites | 15 | 13 | 10 | 3 | 45 |
| 5 | Mats | 0 | | | 0 | 0 |
| 6 | Shop Towels | 31 | 30 | 25 | 5 | 155 |
| 7 | Mops/Feners Covers | 0 | | | 0 | 0 |
| 9 | Cotton Shirts | 11 | 14 | 10 | 4 | 44 |
| 11 | Bar Mops | 24 | 25 | 20 | 5 | 120 |
| 12 | Color Aprons | 0 | | | 0 | 0 |
| 15 | Queens Mats | 0 | | | 0 | 0 |
| 19 | Nomex | 0 | | | 0 | 0 |
| 20 | Cotton Pants | 30 | 32 | 27 | 5 | 150 |
| 28 | HVY Soil Colored Cottons | 28 | 23 | 19 | 4 | 112 |
| | Average | 31.9 | 17.8 | 14.1 | 2.4 | 67.71 |

TABLE B

| | |
|---|---|
| Minutes Saved/Week | 948 |
| Hours Conversion/Week | 15.8 |
| MCF rate | 1 |
| MCF/week | 15.8 |
| Cost per hour of MCF | $ 7.73 |
| Estimated Savings/Week | $ 122.13 |
| Estimated Savings/Month | $ 488.54 |
| Estimated Savings/Year | $6,350.97 |

The data and calculations shown in Tables A and B represent a comparison between the amount of natural gas typically used during the drying process and the amount of natural gas used after making the adjustments. In the sample shown, the drying equipment generally requires one thousand cubic feet of natural gas (1 mcf) for every hour of operation (i.e. "MCF rate"). Consequently, if the hours of operation required are reduced, then less natural gas may be required, which may result in financial savings for the user. Obviously, the cost per hour of MCF and estimated savings are estimates and may vary depending on actual costs.

Figure 4:
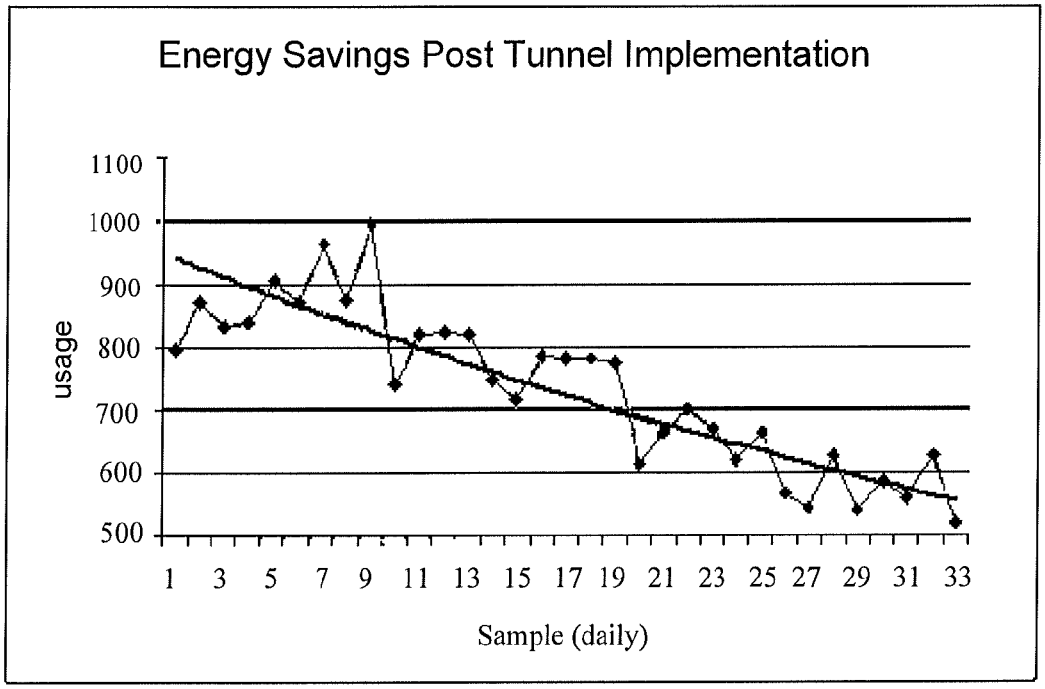
FIG. 4 depicts the energy usage data presented in Table C.

Table C and FIG. 4 further illustrate potential reductions in energy usage resulting from making adjustments to the process parameters in response to the monitoring of the moisture content of the garments at some point during the process. Table A includes the amount of energy used each work day over a seven week time period at a sample laundering plant where an embodiment of the inventive method was utilized.

TABLE C

| | Avg. Energy Usage For the Week | Energy Usage Per Day |
|---|---|---|
| | | 936 |
| | | 796 |
| | | 872 |
| | | 833 |
| Week 1 | 855 | 839 |
| | | 906 |
| | | 873 |
| | | 961 |
| | | 874 |
| Week 2 | 921 | 993 |
| | | 742 |
| | | 820 |
| | | 821 |
| | | 820 |
| Week 3 | 790 | 749 |
| | | 717 |
| | | 785 |
| | | 781 |
| | | 782 |
| Week 4 | 768 | 775 |
| | | 613 |
| | | 664 |
| | | 700 |
| | | 670 |
| Week 5 | 654 | 621 |
| | | 664 |
| | | 568 |
| | | 542 |
| | | 627 |
| Week 6 | 588 | 541 |
| | | 586 |
| | | 562 |
| | | 629 |
| | | 519 |
| Week 7 | 574 | |

FIG. 4 depicts the energy usage data shown in Table C. In the sample depicted in FIG. 4, the energy usage clearly trends downward as a result of implementation of an embodiment of the inventive method. In fact, in this particular sample, implementing an embodiment of the inventive method resulted in a roughly 62% reduction in energy usage, based on the average usage in Week 7 and the highest average energy usage in Week 2. As discussed above, energy may be saved by adjusting the parameters of the laundering, drying and sorting process in order to produce garments that are not over-dried and have a moisture content approximately equal to or above the ambient humidity after drying. The energy savings may result in a more efficient process and significant financial savings.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art.

The invention claimed is:

1. A method of cleaning a first and a second garment comprising the steps of:

performing pre-washing processing steps initially on the first garment and subsequently on the second garment;

washing the first garment according to a plurality of first washing parameters;

drying the first garment according to a plurality of first drying parameters;

measuring a moisture content of the first garment manually with a moisture meter in direct contact with the first garment;

measuring an ambient moisture content;

comparing the moisture content of the first garment with the ambient moisture content;

washing the second garment according to a plurality of second washing parameters;

drying the second garment according to a plurality of second drying parameters; and adjusting at least one of the first washing and first drying parameters based on the comparing step so that the moisture content of the first garment is not less than the ambient moisture content.

2. The method of claim 1, wherein the measuring step of the first garment is performed prior to the drying step for the first garment.

3. The method of claim 2, wherein the adjusting step is completed prior to the drying step for the first garment.

4. The method of claim 1, wherein the drying step for the first garment is completed prior to the initiation of the drying step for the second garment.

5. The method of claim 1 further comprising a plurality of the measuring steps of the first garment, each occurring at different steps in the method.

6. The method of claim 1, wherein the adjusting step further comprises adjusting at least one of the first washing and first drying parameters so that the moisture content of the first garment is approximately equal to the ambient moisture content.

7. The method of claim 1, wherein the first and second garments each comprises an item selected from the group consisting of clothing, towels, linens, mop heads, and rugs.

8. The method of claim 1 further comprising:

inserting a unique identifier onto the first garment to track the first garment during cleaning, wherein the unique identifier comprises a format selected from the group consisting of a manually readable format and a machine readable format.

9. The method of claim 1, wherein the measuring a moisture content of the first garment step further comprises determining whether the measured moisture content of the first garment is above, substantially equal to, or below the threshold amount of moisture.

10. The method of claim 1, wherein the adjusting step further comprises adjusting at least one of the plurality of parameters to achieve a measured moisture content at least substantially equal to the threshold amount of moisture.

11. The method of claim 1, wherein the processing step comprises drying the garment, wherein the measuring a moisture content of the first garment step occurs sequentially immediately after the drying the first garment step.

12. The method of claim 1, wherein the at least one of the first washing and first drying parameters adjusted during the adjusting step is selected from the group consisting of an amount of time spent drying the garment, a temperature at which the garment is dried, a speed at which a washing machine is operated, and a speed at which a conveyor configured to transport the garment is operated.

13. The method of claim 1, wherein the measuring a moisture content of the first garment step is performed outside of a drying work station utilized in the drying step for the first garment.

14. The method of claim 1 further comprising:

removing the first garment from a drying work station after the drying the first garment step and prior to the measuring a moisture content of the first garment step.

15. The method of claim 1, wherein the adjusting step further comprises adjusting the first washing parameters based on the comparing step so that the moisture content of the first garment is not less than the ambient moisture content.

16. A method of cleaning a first and a second garment comprising the steps of:

performing pre-washing processing steps initially on the first garment and subsequently on the second garment;

washing the first garment according to a plurality of first washing parameters;

drying the first garment according to a plurality of first drying parameters;

measuring a moisture content of the first garment manually with a moisture meter in direct contact with the first garment;

measuring an ambient moisture content;

comparing the moisture content of the first garment with the ambient moisture content;

washing the second garment according to a plurality of second washing parameters;

after the drying step for the first garment is completed, drying the second garment according to a plurality of second drying parameters; and adjusting at least one of the first washing and first drying parameters based on the comparing step so that the moisture content of the first garment is approximately equal to the ambient moisture content.

17. The method of claim 16, further comprising a plurality of the measuring steps of the first garment, each occurring at different steps in the method.

18. The method of claim 16, wherein the processing step comprises drying the garment, wherein the measuring a moisture content of the first garment step occurs sequentially immediately after the drying the first garment step.

19. The method of claim 16, wherein the at least one of the first washing and first drying parameters adjusted during the adjusting step is selected from the group consisting of an amount of time spent drying the garment, a temperature at which the garment is dried, a speed at which a washing machine is operated, and a speed at which a conveyor configured to transport the garment is operated.

20. The method of claim 16, wherein the adjusting step further comprises adjusting the first washing parameters based on the comparing step so that the moisture content of the first garment approximately equal to the ambient moisture content.

* * * * *